United States Patent [19]

Eguchi

[11] Patent Number: 4,608,937

[45] Date of Patent: Sep. 2, 1986

[54] DEVICE FOR STABILIZING STITCHES IN A SEWING MACHINE

[75] Inventor: Yasukata Eguchi, Kunitachi, Japan

[73] Assignee: Janome Sewing Machine Co., Ltd., Tokyo, Japan

[21] Appl. No.: 709,787

[22] Filed: Mar. 11, 1985

Related U.S. Application Data

[63] Continuation-in-part of Ser. No. 460,885, Jan. 25, 1983, abandoned.

[30] Foreign Application Priority Data

Feb. 4, 1982 [JP] Japan ..... 57-15560

[51] Int. Cl.[4] ..... D05B 27/22; D05B 3/00

[52] U.S. Cl. ..... 112/121.13; 112/221; 112/317

[58] Field of Search ..... 112/121.13, 314, 315, 112/316, 317, 157, 158 R, 221

[56] References Cited

U.S. PATENT DOCUMENTS

| | | | |
|---|---|---|---|
| 3,060,875 | 10/1962 | Iida | 112/316 X |
| 3,481,291 | 12/1969 | Schilling | 112/221 X |
| 4,241,677 | 12/1980 | Beisler | 112/221 X |

*Primary Examiner*—H. Hampton Hunter

*Attorney, Agent, or Firm*—Michael J. Striker

[57] ABSTRACT

A device for stabilizing stitches in a sewing machine comprises a feed adjuster and a transmission mechanism imparting a turning movement to the needle in the plane normal to the elongation of the needle such that uniform and stable stitches are made in forward stitching and in backward stitching as well.

5 Claims, 5 Drawing Figures

DEVICE FOR STABILIZING STITCHES IN A SEWING MACHINE

CROSS-REFERENCE TO A RELATED APPLICATION

The present application is a continuation-in-part of application Ser. No. 460,885 filed Jan. 25, 1983, and now abandoned.

BACKGROUND OF THE INVENTION

The present invention relates to a device mounted in the sewing machine for making uniform all the stitches formed by a sewing machine in all directions.

In the prior art, stitches are often formed such that perfect stitches denoted as P and hitch stitches designated as H in FIG. 4 are mixed stitch finishing is unseemly.

SUMMARY OF THE INVENTION

An object of the invention is to make uniform the stitches to be formed by a sewing machine in all directions, especially stitches to be formed in backward stitching, for example, arrange all the stitches as the perfect stitches and to thus realize pretty and stable stitches.

Another object of the invention is to provide a device of simple structure, with which all of the stitches may be made perfect in the backward stitching.

These and other objects of the invention are attained by a device for producing stable stitches, utilizing upper and lower threads, in a sewing machine for a fabric being movable in forward and backward directions, comprising a reciprocable needle bar having an axis and a needle with a lower end, the upper thread being secured to said lower end of said needle; a machine frame; a loop taker; an upper drive shaft rotatably supported in said machine frame and vertically reciprocating said needle bar so that stitches are produced in the fabric to be sewn, the stitches being composed of the upper thread and the lower thread which is supplied as the fabric is transported in one direction and is interlocked with the upper thread by said loop taker; a feed regulator having a first and a second position, said feed regulator being pivotable to said first position for transporting the fabric in the forward direction and to said second position for transporting the fabric in the backward direction; transmission means; said transmission means being operatively interconnected between said needle bar and said feed regulator and operating in association with said regulator when said regulator is pivoted to said second position so that said needle bar is axially rotated in a counterclockwise direction by a predetermined angle between 10° and 45° so as to displace the upper thread in the counterclockwise direction and to prevent the upper thread from being non-uniformly interclocked by the lower thread; and means for holding said needle bar such that said needle bar may be vertically reciprocated and axially rotated.

The device may further comprise a spring, said feed regulator being normally biased in said first position by said spring such that said feed regulator will be normally adapted to transport the fabric in the forward direction.

The device may further include operating means operatively connected to said feed regulator and including a part that is accessible and manually operated in a one direction so as to pivot said feed regulator to said second position against the action of said spring.

A needle bar holder may be further pivoted, said needle bar holder having first and second ends, said first end being operatively connected to said upper drive shaft, said second end turnably holding said needle bar, said needle bar guide cramping said second end of said needle bar and being secured to said needle bar.

The transmission means may include a crank having two arms one of which is operatively connected to said feed regulator and is pivotable in at least one direction in dependence upon the position of said feed regulator; a transmission rod having two ends one of which being operatively connected to the other arm of said crank; and a guide plate being turnable about said axis of said needle bar and being operatively connected to said needle bar guide such that said needle bar may be turned together with said guide plate while said needle bar guide is vertically guided by said guide plate, said guide plate having a part that is operatively connected to the other end of said transmission rod.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawing.

DETAILED DESCRIPTION OF THE PREFERRED EMBODIMENT

Figure 1:
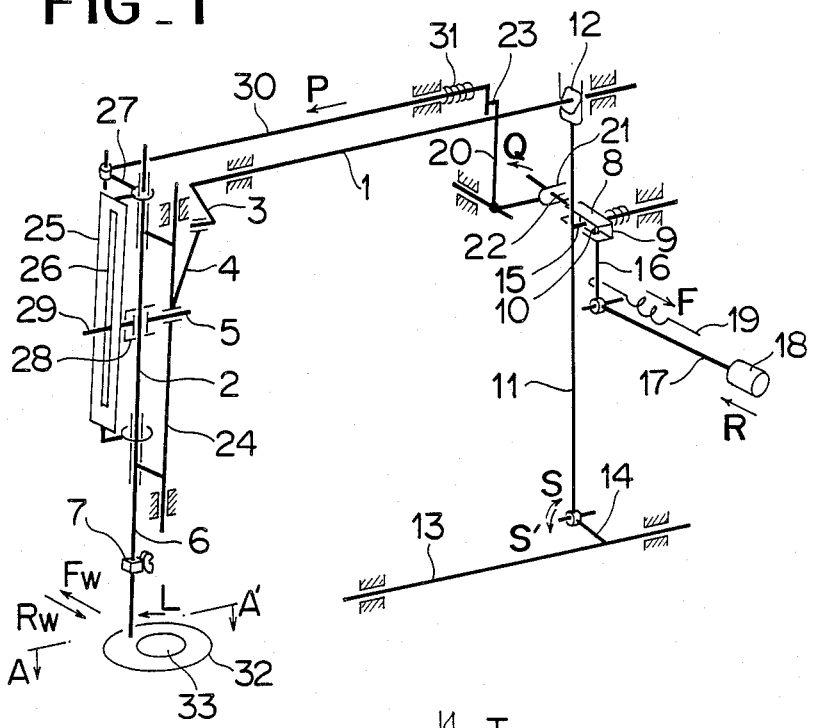
FIG. 1 is a schemcatic view of the device of the invention.

In FIG. 1, numeral 1 is an upper shaft rotatably supported in an arm frame of the sewing machine. Reference character 2 identifies a needle bar which is vertically moved in association with rotation of the upper shaft 1 via a needle bar crank rod 4 and a needle bar holder 5, the rod 4 being held at its upper end on a take-up crank 3 fixed to the upper shaft 1, and the bar holder 5 being connected to the needle bar crank rod 4 at its lower end portion. Numeral 6 denotes a needle fixed by a needle holder 7 which is mounted on the needle bar 2 at its lower part. Reference numeral 8 designates a feed regulator which is turnably held on an appropriate portion within the arm frame, and which is formed with a groove 9 in which a sliding member 10 moves.

The numeral 11 is a vertically extended fork rod for horizontal feed, and a fork portion at the upper end of rod 11 engages a feed cam 12 which is secured to the upper shaft 1. The fork rod 11 is, at its lower end, connected to an arm 14 of a horizontal feed shaft 13 rockably held in a bed frame. The fork rod 11 has a laterally extended pin 15 connected to the sliding member 10.

The feed regulator 8 has a downwardly extended arm 16 which is connected at its end with a rod 17 having an accessible push button 18 operable outside of the machine frame.

The arm 16 normally biases a spring 19 in the direction of arrow F, so that the feed regulator 8 is angularly positioned for forward stitching. Numeral 20 is a fork crank turnably mounted on the machine frame. Crank 20 has a fork portion 21 which engages an arm or connecting rod 22 provided at a rear end of the feed regulator 8. Crank 20 also has a crank arm 23 at its upper end.

The needle bar 2 is held by a needle bar support 24 via its upper and lower arms 24*a*, 24*b* so that it may be vertically moved in the axial direction thereof. The support 24 is swingably supported on the machine frame such that it may be utilized for zigzag stitching, and is operatively connected to a zigzag movement generator (not shown), so that the support may be swingably moved in accordance with the zigzag movement while the needle bar 2 is vertically reciprocated.

A needle bar guide plate 25 is held by the arms of the needle bar support 24 such that plate 25 is swingably around the needle bar 2. Plate 25 is formed with a square guide groove 26 extended in parallel with the axis of elongation of the needle bar 2 and is provided with an arm 27 at its upper end.

Within the guide groove 26, a short rod 29 of a guide holder 28 secured to the needle bar 2 is guided such that it is vertically moved in synchronism with the needle bar. The numeral 30 is a transmission rod connected to arm 27 of the plate 25, rod 30 being equipped at one side thereof with a compression spring 31 and is connected to crank arm 23 of the fork crank arm 20. Numeral 32 denotes a horizontal, full rotation loop taker rotated in the direction of arrow L, which loop taker holds a lower thread bobbin 33.

When the upper shaft 1 is rotated by the motor of the sewing machine, the needle bar 2 is vertically reciprocated via rotation of the take-up crank 3 and the connecting members of the needle bar crank 4 and the needle bar holder 5, and the horizontal, full rotation loop taker 32 is also rotated, so that the upper and lower threads are crossed in association with the needle 6 provided at the lower end of the needle bar 2. When the needle bar 2 is swingably moved by the zigzag generator of the sewing machine, this movement is effected in synchronism with the vertical movement of the needle bar 2.

Due to the rotation of the upper shaft 1 the feed cam 12 is rotated and the fork rod 11 is swingably moved, and accordingly the horizontal feed shaft 13 is rockingly moved. The amount of the rocking movement of the horizontal feed arm 13 may be adjusted by a tilting amount of the groove 9 of the feed regulator 8.

When the horizontal feed shaft 13 is rocked in the direction of arrows S and S′ shown in FIG. 1, while the feed regulator 8 is biased to the forward stitching condition by the spring 19, a feed dog (not shown) is effected with the horizontal movement which feeds the fabric (w) in the direction of arrow (Fw).

When the push button 18 is pressed in the direction of arrow R against the action of the spring 19, and the feed adjuster 8 is tilted toward a condition of the backward stitching, the feed dog feeds the fabric (w) in the direction of arrow (Rw), and the arm shaft 22, provided at the rear end of the feed regulator turns the fork crank arm 20 in the direction of arrow Q in the counterclockwise direction in FIG. 1 so that the transmission rod 30 axially moves in the direction of arrow P against the action of the spring 31 and thus rotates the needle bar guide plate 25.

Figure 2:
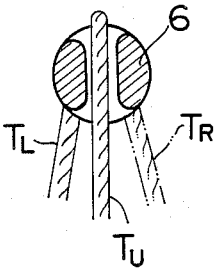
FIG. 2 is a cross sectional view through a needle on line A—A′ in FIG. 1.
Figure 3:
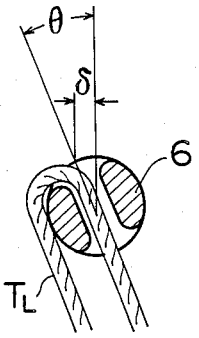
FIG. 3 is a cross sectional view on line A—A′ during operation.

Therefore the guide holder 28 within the groove 26 of the needle bar guide plate 25 will axially rotate the needle bar 2 so that the needle 6 fixed at the lower end of needle bar 2 is rotated in the counterclockwise direction in FIG. 1, and the needle eye changes its position from a condition shown in FIG. 2 to a condition dipicted in FIG. 3, by angle $\theta$ in the counterclockwise direction.

The slide element 10 is one of the basic elements of a sewing machine. The forked rod 11 has the forked part, which as described herein above, is in engagement with the feed cam 12 secured to an upper drive shaft 1 of the sewing machine. The forked rod 11 has the lower end operatively connected to the horizontal feed shaft 13 by arm 14. The forked rod 11 has a transverse pin 15 secured thereon. The slide element 10 is turnably connected to the transverse pin 15 and is in engagement with groove 9 of the feed regulator 8, which is turnably mounted on the machine frame. The feed regulator may be turned with respect to the forked rod 11 bu manual operation of rod 17 through depending arm 16. Thus the angular position of the feed regulator may be changed with respect to the forked rod 11. As also noted above the connecting rod 22 secured to the regulator 8 engages the forked end 21 at one end the crank 20 which is turnably mounted on the machine frame. The crank 20 has the other end 23 operatively connected to one end of the transmission rod 30 which has the other end operatively connected to the needle bar 6.

The operation of the feed regulator 8 and the transmission means of the sewing machine is as follows: When the upper drive shaft 1 is rotated, the forked rod 11 is rocked to and fro by the feed cam 12 around the lower pivot at the end of the arm 14. More precisely, when the feed regulator 8 is set to a horizontal position, that is, substantially normal to the forked rod 11, the forked rod 11 is simply rocked around the lower pivot and gives no influence to the horizontal feed shaft 13 because the slide element 10 is also simply moved to and fro in the groove 9 of the feed regulator 8. However, if the feed regulator 8 is inclined with respect to the forked rod 11, the forked rod 11 is rocked to and fro and at the same time is vertically reciprocated due to the movement of the slide element 10 along the inclined groove 9 of the feed regulator 8. The amount of the vertical reciprocation is determined by the inclined amount of the feed regulator 8. As a result, the vertical reciprocation of the forked rod 11 is transmitted to the horizontal feed shaft 13 by way of the connecting arm 14. Then the horizontal feed shaft 13 is rocked to reciprocate the feed dog (not shown) in a horizontal plane.

Although not shown, there is a conventional device for vertically reciprocating the feed dog in a timed relation with the upper drive shaft 1 and the horizontal feed shaft 13. Thus the horizontal feed shaft 13 and the vertically reciprocating device (not shown) cooperate with each other to move the feed dog substantially in a parallelogram path to transport the fabric in the forward or backward direction. Therefore the fabric transporting amount or pitch is determined by the inclined amount of the feed regulator 8.

The feed regulator 8 is normally biased in one direction by spring 19 so as to feed the fabric in the forward direction with a predetermined standard pitch or amount. Therefore if the operating rod 17 is pushed against the action of the spring 19, the feed regulator 8 is turned in the opposite direction. As a result, the connecting rod 22 of the feed regulator 8 is turned in the same direction and turns the crank 20 in the counterclockwise direction as shown by arrow Q, to thereby move the transmission rod 30 in the leftward direction against the action of the spring 31 as indicated by the arrow P. Therefore the needle bar 6 is axially turned in the counterclockwise direction as shown in FIG. 3 from the normal condition shown in FIG. 2. Simultaneously the forked rod 11 cooperates with the above-mentioned known device for vertically reciprocating the feed dog, to transport the fabric in the backward direction.

Figure 4:
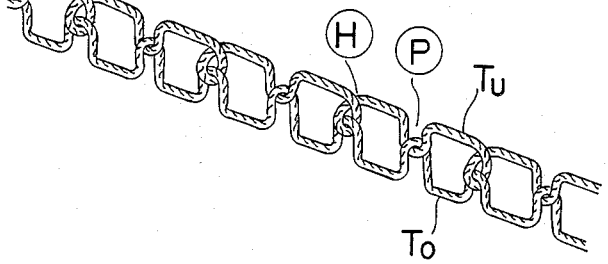
FIG. 4 is a stitch forming structural view of a backward stitch obtained in a conventional sewing machine.

FIG. 2 is a cross sectional view through the needle eye of the needle 6 as taken on line A—A′ of FIG. 1. If the backward stitching is carried out, and end point T′ of an upper thread Tu is pulled by the cloth (w) and is biased to the left side of the needle stem from the center of the needle 6 ($T_L$ in FIG. 2), or to the right side ($T_R$ in FIG. 2) with 50% probability. Accordingly, the stitches are formed as perfect stitches P and the hitch stitches H (see FIG. 4).

Figure 5:
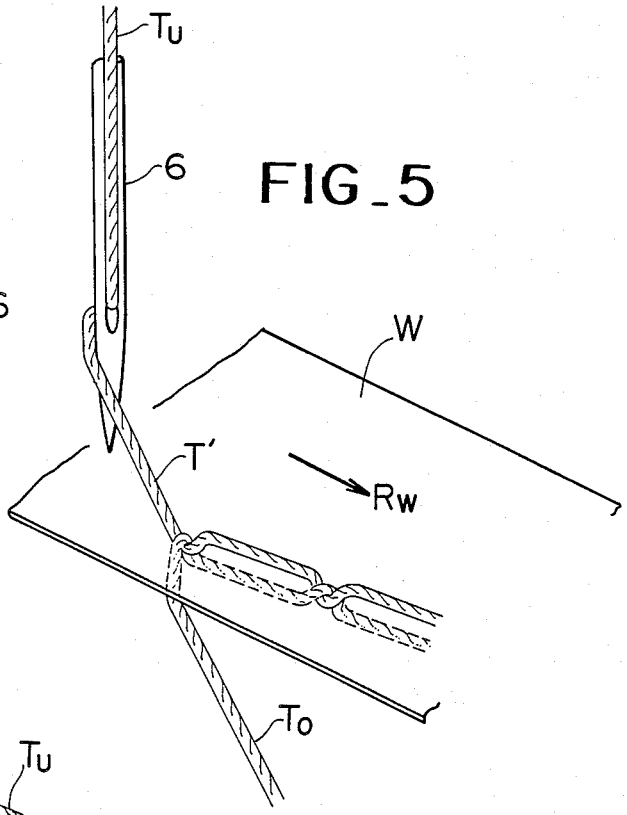
FIG. 5 shows a condition of the thread in stitching with the device according to the invention.

However, according to the invention, if the push button 18 is operated for the backward stitches, the needle 6 is axially rotated by angle $\theta$ as seen in FIG. 3, in the counterclockwise direction, so that the needle eye is tilted toward the left side. If the needle eye is made oblique by angle $\theta$, the center of an exit of the needle eye is offset to the left side by distance $\delta$, so that a part ($T_L$) of the upper thread exiting from the needle eye is pulled by the cloth (w) in the direction of Rw, and at this time the thread is biased to the left side of the needle stem. Angle $\theta$, by which the needle bar 6 is turned to the left side or in the counterclockwise direction, upon the actuation of regulator 8, is in the range between 10° and 45°, whereby undesired hitch stitches are prevented from occurrence. In such a manner, the probability is as high as 100%. Therefore the stitches are made uniform in the all directions and are perfect stitches as shown in FIG. 5. When the operation of the operator 18 is interrupted, the feed adjuster 8 is returned to the initial forward stitching condition by the action of spring 19 and the needle bar 2 is also rotated to its original position.

The above mentioned description has referred to the structure to be manually operated. In case of the structure which carries out automatic backward stitching in dependence upon a cam control system, the needle bar is rotated together with the feed regulator by means of a cam, and in case of the structure depending upon an electronic memory signal, the needle bar is rotated by means of the electronic memory signal.

Since the above described embodiment is of the structure which supplies the lower thread from the side of the machine operator, the needle is rotated in the counterclockwise direction but depending upon a position of supplying the lower thread, in a type, for example, which supplies the lower thread from the rear side of the needle, the needle bar should be rotated, in the backward stitching, in the clockwise direction, and obviously the rotational direction should be selectively changed in accordance with the embodiment.

It will be understood that each of the elements described above, ot two or more together, may also find a useful application in other types of stitches stabilizing devices differing from the types described above.

While the invention has been illustrated and described as embodied in a stitch stabilizing device for, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A device for producing stable stitches, utilizing upper and lower threads, in a sewing machine for a fabric being movable in forward and backward directions, comprising:

a reciprocable needle bar having an axis and a needle with a lower end, the upper thread being secured to said lower end of said needle;

a machine frame;

a loop taker;

an upper drive shaft rotatably supported in said machine frame and vertically reciprocating said needle bar so that the stitches are produced in the fabric to be sewn, the stitches being composed of the upper thread and the lower thread which is supplied as the fabric is transported in one direction and is interlocked with the upper thread by said loop taker;

a feed regulator pivotable to a first position for transporting the fabric in the forward direction and to a second position for transporting the fabric in the backward direction;

transmission means, said transmission means being operatively interconnected between said needle bar and said feed regulator and operating in association with said regulator when said regulator is pivoted to said second position so that said needle bar is axially rotated in a counterclockwise direction through a predetermined angle from 10° to 15° so as to displace the upper thread and thereby to prevent the upper thread from being non-uniformly interlocked by the lower thread; and means for holding said needle bar such that said needle nar may be vertically reciprocated and axially rotated.

2. The device as defined in claim 1; further comprising a spring, said feed regulator being normally biased in said first position by said spring such that said feed regulator will be normally adapted to transport the fabric in the forward direction.

3. The device as defined in claim 2; further comprising operating means operatively connected to said feed regulator and including a part that is accessible and manually operated in a one direction so as to pivot said feed regulator to said second position against the action of said spring.

4. The device as defined in claim 2; further comprising a needle bar holder, said needle bar holder having first and second ends, said first end being operatively connected to said upper drive shaft, said second end turnably holding said needle bar, said needle bar guide cramping said second end of said needle bar holder and being secured to said needle bar.

5. The device as defined in claim 4, wherein said transmission means includes a crank having two arms, one of which is operatively connected to said feed regulator and is pivotable in at least one direction in dependence upon the position of said feed regulator, a transmission rod having two ends, one of which is operatively connected to the other arm of said crank, and a guide plate being turnable about said axis of said needle bar and being operatively connected to said needle bar guide such that said needle bar may be turned together with said guide plate while said needle bar guide is vertically guided by said guide plate, said guide plate having a part which is operatively connected to the other end of said transmission rod.

* * * * *